US006431144B1

(12) United States Patent
Daly

(10) Patent No.: US 6,431,144 B1
(45) Date of Patent: Aug. 13, 2002

(54) ELECTRONIC THROTTLE CONTROL SYSTEM

(75) Inventor: Paul D. Daly, Troy, MI (US)

(73) Assignee: Siemens VDO Automotive Inc., Tilbury (CA)

( * ) Notice: Subject to any disclaimer, the term of this patent is extended or adjusted under 35 U.S.C. 154(b) by 0 days.

(21) Appl. No.: 09/648,363

(22) Filed: Aug. 25, 2000

Related U.S. Application Data

(60) Provisional application No. 60/152,178, filed on Sep. 2, 1999.

(51) Int. Cl.[7] ..... F02D 11/10; F02D 9/10

(52) U.S. Cl. ..... 123/399; 251/129.11

(58) Field of Search ..... 123/399; 318/280; 251/129.09, 129.04, 129.11

(56) References Cited

U.S. PATENT DOCUMENTS 4,926,821 A * 5/1990 Porth et al. ..... 123/399
5,078,110 A 1/1992 Rodefeld ..... 123/399
5,912,538 A 6/1999 Turner ..... 318/280

FOREIGN PATENT DOCUMENTS

DE 19740347 3/1999
JP 59188050 10/1984
JP 59-188050 * 10/1984

OTHER PUBLICATIONS

European Search Report For EP 00 11 8936, Nov. 6, 2000.

* cited by examiner

*Primary Examiner*—Andrew Dolinar
*Assistant Examiner*—Johnny H. Hoang

(57) ABSTRACT

An electronic throttle control system for a vehicle accommodates situations where ice forms on one or more throttle assembly components. Rapid movement is induced in the throttle assembly to generate a high torque for a short period of time to break up any ice formation. A controller preferably induces motion at a resonant frequency of the assembly for a controlled period of time. In a disclosed embodiment, a first frequency is used when the throttle blade is in a first position while a second frequency is used when a throttle blade is in a second position. The preferred embodiment includes a vibration enhancing element.

21 Claims, 2 Drawing Sheets

ELECTRONIC THROTTLE CONTROL SYSTEM

RELATED APPLICATIONS

This application claims priority to U.S. Provisional Application No. 60/152,178, which as filed on Sep. 2, 1999.

BACKGROUND OF THE INVENTION

This invention generally relates to vehicle throttle controls. More particularly, this invention relates to controlling an electronic throttle control to ensure proper performance.

Vehicle throttle bodies typically include an air intake opening. A blade is typically positioned within the opening and moved between opened and closed positions to control the amount of air intake. Conventional arrangements include mechanical linkages and springs to manipulate the position of the blade responsive to movement of the accelerator petal.

More recently, alternative arrangements have been proposed. One proposal by the owner of this application has been to replace the mechanical linkages and springs with an electronic throttle control arrangement. One challenge facing the designers of such arrangements is how to accommodate situations where there may be interference with proper operation of the assembly for moving the blade into a desired position. One example scenario is when ice forms on the blade or the throttle body. It is necessary to be able to generate enough force to overcome the impediment presented by ice.

There is a conflicting concern between generating sufficient force while maintaining components within the limited space available for the throttle body assembly. Additionally, vehicle suppliers are constantly striving to minimize the cost of vehicle components.

This invention provides an arrangement that utilizes a relatively small electric motor, controlled in a desired fashion, to free up frozen throttle components in the event that ice forms on one or more of the components.

SUMMARY OF THE INVENTION

In general terms, this invention is an electronic throttle body control system that is capable of overcoming any difficulties presented by ice formation on one or more throttle assembly components. A system designed according to this invention includes a throttle body having an opening. A blade portion is supported within the body opening and selectively positioned to control air flow into the opening. An electric motor assembly provides a motive force to move the blade portion. A controller controls operation of the electric motor assembly such that the motor and blade portion move rapidly and at a selected frequency for a selected period of time in the event that ice is present.

The preferred embodiment includes making a temperature determination to ensure that a difficulty in moving the blade portion is likely caused by the formation of ice on one or more throttle assembly components. The preferred embodiment also includes inducing motion within the throttle assembly at a first frequency if the blade is frozen into an open position but inducing motion at a second frequency if the blade is frozen in a closed position.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
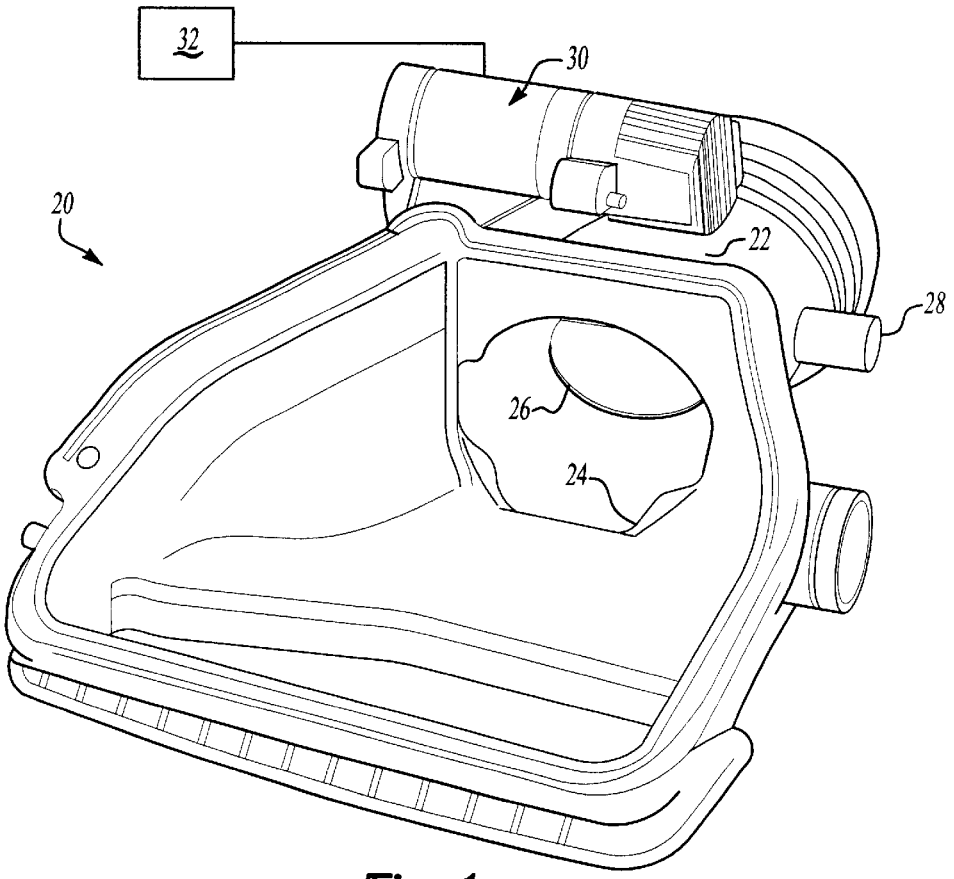
FIG. 1 diagrammatically illustrates a throttle assembly designed according to this invention.
Figure 2:
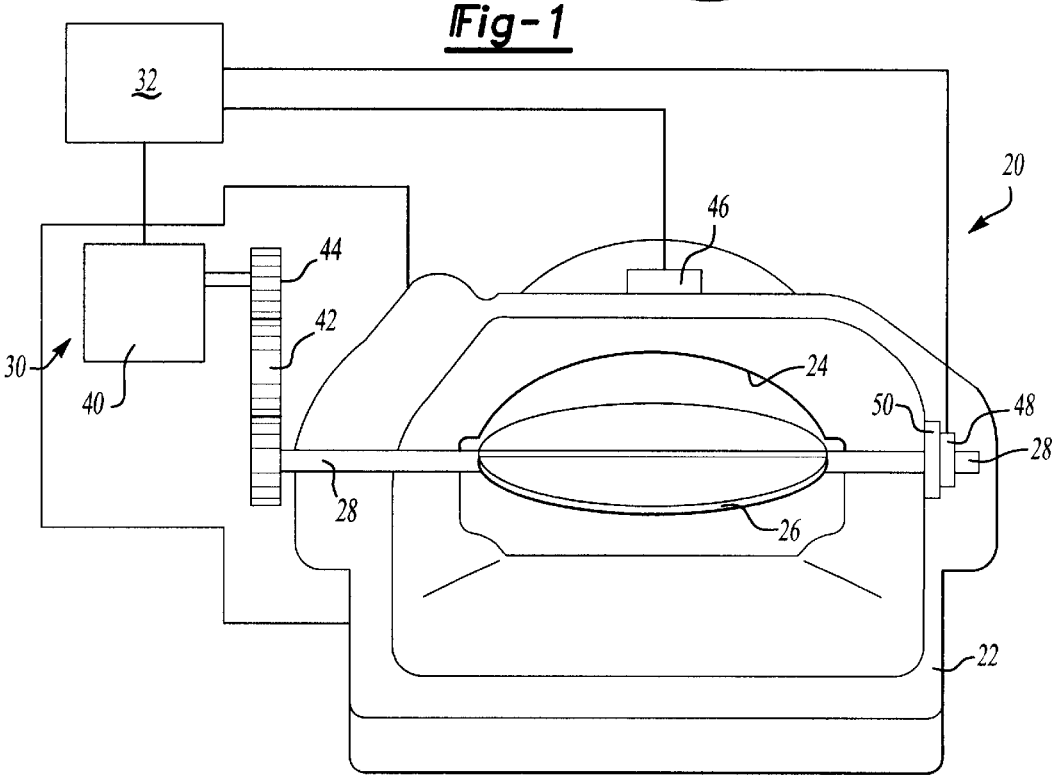
FIG. 2 shows the example of FIG. 1 from another perspective.

FIGS. 1 and 2 show a throttle assembly 20 including a throttle body 22 having an air intake opening 24. A blade portion 26 is supported on a shaft 28 within the opening 24. The blade portion 26 is moved between opened and closed positions to control the amount of air flow into the opening 24.

The blade 26 preferably is manipulated into various positions within the opening 24 by an electric motor assembly 30. An electronic controller 32 controls the motor assembly 30 to provide the proper motive force for moving the blade 26 into a desired position.

The electric motor assembly 30 preferably includes an electric armature or force generating portion 40 and a plurality of gears 42 and 44 that interact with the shaft 28 to rotate the shaft 28 about its axis. Rotation of the shaft 28 results in movement of the blade portion 26 between various positions within the opening 24.

The preferred embodiment includes a temperature sensor 46 supported near the throttle body for detecting a temperature in the vicinity of the throttle assembly components. Information from the temperature sensor 46 preferably is interpreted by the controller 32 and used as described below.

A potentiometer 48 preferably is supported on the shaft 28. The potentiometer 48 provides feedback information to the control 32 regarding the position of the shaft 28. Additionally, the potentiometer 48, according to a preferred embodiment of this invention, is useful as a temperature sensor. Resistive elements within the potentiometer 48 provide temperature information to the controller 32 upon measuring the resistance value of the resistor elements. As is known, the resistance value of a resistor changes with temperature and the known relationships can be used by a suitably programmed microprocessor to determine temperature information as needed. Another source of temperature information is the resistance of the motor windings and the motor assembly 30.

The preferred embodiment also includes a vibration enhancing element 50 which preferably includes an elastomeric portion and a solid mass that are selected to enhance vibratory or oscillating movement of the shaft 28, the blade 26 and the various components of the electric motor assembly 30.

Figure 5:
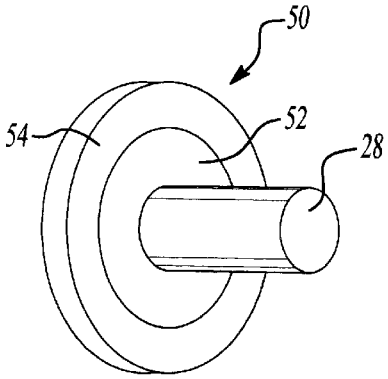
FIG. 5 illustrates another example of a vibration enhancer.

FIG. 5 illustrates one example of a vibration enhancer 50. A resilient ring portion 52 is supported on the shaft 28. A solid mass portion 54 surrounds the resilient ring portion 52.

Figure 4:
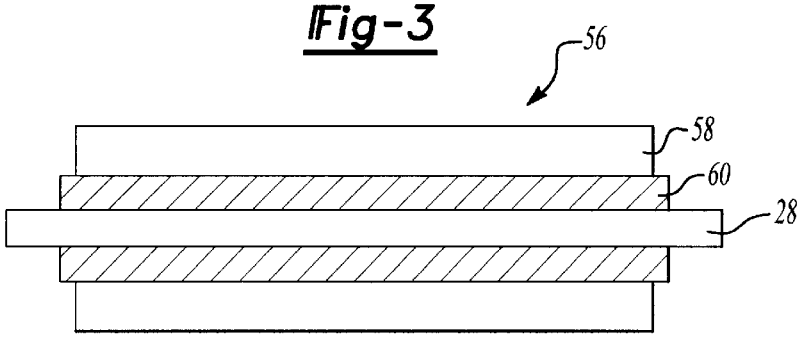
FIG. 4 illustrates a vibration enhancer preferably used as part of a system designed according to this invention.

Another example of a vibration enhancer 56 is illustrated in FIG. 4. A solid mass 58 is elongated along a portion of the shaft 28. A resilient damping portion 60 is interposed between the shaft 28 and the mass 58. Selecting the size and weight of the mass portion and the characteristics of the resilient portion provide the ability to tune the vibration characteristics of the throttle control assembly. The vibration enhancer 50 or 56 preferably maximizes vibration torque or displacement under selected conditions. Given this description, those skilled in the art will be able to choose an appropriate arrangement to address the needs of a particular situation.

One issue that is faced within vehicle throttle assemblies is overcoming the possible impediment presented by ice formation on one or more of the throttle assembly components. The system designed according to this invention addresses that need by utilizing the controller 32 to introduce rapid vibrations in the throttle assembly components for a selected period of time. Rapidly moving the components at a selected frequency for a short period of time is sufficient to generate enough force (2Nm in one example) to break any ice build up on the components. Then a lower force can be used to drive the components to achieve the desired throttle assembly operation. In the preferred embodiment, the controller 32 induces motion within the throttle assembly at first frequency when the blade portion 26 is frozen within an open position. A second frequency preferably is used when the blade portion 26 is frozen in a closed position. Different frequencies are preferred to maximize vibration. At different positions, the assembly components are in different positions and, therefore, different frequencies maximize torque.

In one example, the preferred frequency at which oscillations are induced under icing conditions is the natural, resonant frequency of the throttle assembly components. In the preferred embodiment, the natural or resonant frequency of the shaft 28, blade 26, motor assembly 30 (including the gears 42 and 44) and the vibration enhancing element 50 is determined and modeled within software in the controller 32. The throttle assembly components preferably then are driven at a frequency corresponding to the resonant frequency for a limited period of time to induce harmonics within the system that will generate sufficient force to break any ice that has formed on the throttle assembly components.

In one example, a series of pulses are provided by the controller 32 to the motor assembly 30 to induce the appropriate response. It is desirable to limit the amount of time that high force build up occurs because of the resonant frequency so that the number of pulses is tightly controlled. Alternatively, the controller 32 is programmed to monitor the amount of time that the selected frequency is provided.

Figure 3:
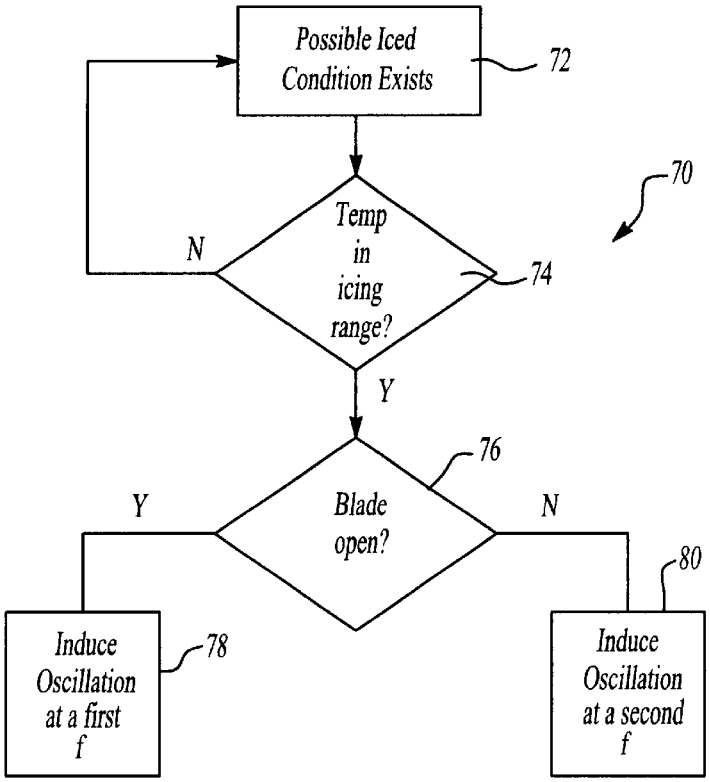
FIG. 3 is a flow chart diagram illustrating a method of this invention.

As illustrated in FIG. 3, the method of this invention includes making several determinations and controlling the throttle assembly accordingly. The flow chart 70 includes a first step at 72 where a determination is made that a possible iced over condition exists because, for example, the potentiometer 48 indicates that the shaft 28 cannot be moved when the motor armature 40 is energized to adjust the position of the blade 26. When it appears that one or more of the throttle assembly components may include ice, the controller 32 determines at 74 whether the temperature in the vicinity of the throttle assembly is within an icing range. Temperature information is gathered from the temperature sensor 46 and/or by measuring the resistance value of resistor elements within the potentiometer 48, for example. If the temperature is below a chosen threshold (in one example, 35 degrees F°), then the controller 32 proceeds to the step 76.

A determination is made regarding the position of the blade 26 within the opening 24. Such position information can be obtained, for example, from the potentiometer 48. When the blade is in an open position, a first frequency is used at 78 to induce osolations within the throttle assembly. If the blade is in a closed position, however, a second frequency preferably is used at 80 to induce motion within the throttle assembly. As mentioned above, the amount of time during which the high torque motions are induced preferably is tightly controlled.

Given this description, those skilled in the art will be able to suitably program a microprocessor to induce the necessary motion using appropriate frequencies for the arrangement of a particular throttle assembly.

A significant advance is provided by this invention because the motor assembly 30 and the other throttle assembly components can be oscillated at their natural frequency to generate a large deflection and torque. This is sufficient to break ice but does not require a large amount of current for the motor. Further, smaller motor design is possible that takes up less room and is more economical. Additionally, there is less heat dissipation using the strategy of this invention.

Another feature of this invention is accommodating changes in humidity in the vicinity of the throttle assembly. When one or more throttle assembly components are made from nylon, the presence of humidity can alter the dimensions of the component. For example, if the blade portion 26 is made from nylon but the throttle body 22 is made of metal, prolonged humidity can affect the offset for the minimum air flow expected based upon the position of the blade portion 26 within the opening 24. The same is true when the throttle body 22 is made of nylon and the blade portion 26 is made of metal or another material.

The preferred embodiment includes using air temperature and altitude information to derive humidity information. The controller 32 preferably is programmed with a model for stiffness expression using temperature and humidity information to accommodate for changes in stiffness of the components caused by changes in humidity. The model within the controller 32 preferably recognizes that humidity effects only occur after humidity has been present at certain levels for certain periods of time. Therefore, monitoring temperature and engine operation provides useful information for making accurate humidity effect determinations.

Given this description, those skilled in the art will be able to suitably program the controller 32 to accommodate the effects of humidity on one or more of the components of the throttle assembly. The sensor 46 in one example, includes a humidity sensor to provide additional humidity information.

The preceding description is exemplary rather than limiting in nature. Variations and modifications to the disclosed embodiments may become apparent to those skilled in the art that do not necessary depart from the spirit or purview of this invention. The scope of legal protection given to this invention can only be determined by the following claims.

I claim:

1. A vehicle throttle control system, comprising:

a throttle body having an opening;

a blade portion supported within the body opening and selectively positioned to control air flow into the opening;

a shaft supporting the blade and at least one vibration enhancing member associated with the shaft;

an electric motor assembly that provides a motive force to move the blade portion; and a controller that controls operation of the electric motor assembly such that the motor and blade portion move rapidly and at a selected frequency for a selected period of time.

2. The system of claim 1, wherein the selected frequency is a resonant frequency.

3. The system of claim 2, wherein the resonant frequency is a resonant frequency of the blade portion and the motor assembly, collectively.

4. The system of claim 1, wherein the controller energizes the motor assembly such that the motor assembly causes the shaft to move at a frequency that corresponds to a resonant frequency of the blade portion, the shaft, the vibration enhancing member and the motor assembly, collectively.

5. The system of claim 1, including a temperature sensor supported near the throttle body, wherein the controller receives temperature information from the sensor and the controller only causes the motor to move the blade portion at the selected frequency when the sensed temperature is below a chosen threshold.

6. The system of claim 5, wherein the chosen threshold is in a range from approximately 35° F. to about 30° F.

7. The system of claim 5, wherein the temperature sensor comprises a resistor and the controller obtains temperature information from a resistance value of the resistor.

8. The system of claim 1, wherein the controller determines a position of the blade and the selected frequency is a first value when the blade is in a first position relative to the opening and a second value when the blade is in a second position relative to the opening.

9. A method of controlling an electronic throttle control assembly for a vehicle that includes a blade portion, comprising the steps of:

(A) determining whether a condition exists where at least one portion of the assembly is not able to move in a desired manner; and (B) inducing motion in the assembly at a first frequency when the blade portion is in a first position and at a second frequency when the blade portion is in a second position for a selected period of time.

10. The method of claim 9, including determining a temperature in the vicinity of the assembly and performing step (B) only when the temperature is below a chosen threshold.

11. The method of claim 10, wherein the chosen threshold is in a range from approximately 35° F. to about 30° F.

12. The method of claim 10, including determining a resistance value of a resistor in the vicinity of the assembly.

13. The method of claim 9, wherein step (A) includes determining whether a portion of the assembly is frozen in a position.

14. The method of claim 9, wherein the selected frequency is a resonant frequency of the assembly.

15. The method of claim 9, wherein there is an electric motor as part of the assembly and step (B) includes providing power to the motor at a rate that induces motion in the assembly at a resonant frequency of the assembly.

16. A vehicle throttle control system, comprising:

a throttle body having an opening;

a blade portion supported within the body opening and selectively positioned to control air flow into the opening;

an electric motor assembly that provides a motive force to move the blade portion; and a controller that controls operation of the electric motor assembly such that the motor and blade portion move rapidly and at a selected frequency for a selected period of time, the controller determining a position of the blade and selecting a first frequency when the blade is in a first position relative to the opening and a second frequency when the blade is in a second position relative to the opening.

17. The system of claim 16, wherein the first blade position corresponds to a closed position.

18. The system of claim 16, including a shaft supporting the blade and at least one vibration enhancing member associated with the shaft.

19. A method of controlling an electronic throttle assembly for a vehicle, comprising the steps of:

(A) proving a blade portion that is selectively moveable to control an amount of air flow through an opening in the throttle control assembly;

(B) supporting the blade portion on a shaft within the assembly;

(C) providing a vibration enhancing member associated with the shaft;

(D) determining whether a condition exists where at least one portion of the assembly is not able to move in a desired manner; and (E) inducing motion in the assembly at a selected frequency for a selected period of time.

20. The method of claim 19, including performing step (E) at a first frequency when the blade portion is in a first position and at a second frequency when the blade portion is in a second position relative to the opening.

21. The method of claim 20, including determining whether the blade portion is in an open position or a closed position and selecting the first or second frequency depending on the determined blade position.

* * * * *